US011097145B2

(12) United States Patent
Kelly

(10) Patent No.: US 11,097,145 B2
(45) Date of Patent: Aug. 24, 2021

(54) FREE WEIGHT BELT SQUAT MACHINE

(71) Applicant: Sean Kelly, Miami Beach, FL (US)

(72) Inventor: Sean Kelly, Miami Beach, FL (US)

( * ) Notice: Subject to any disclaimer, the term of this patent is extended or adjusted under 35 U.S.C. 154(b) by 28 days.

(21) Appl. No.: 16/581,950

(22) Filed: Sep. 25, 2019

(65) Prior Publication Data

US 2020/0094099 A1 Mar. 26, 2020

Related U.S. Application Data

(60) Provisional application No. 62/736,551, filed on Sep. 26, 2018.

(51) Int. Cl.

| | |
|---|---|
| ***A63B 21/065*** | (2006.01) |
| ***A63B 21/00*** | (2006.01) |
| ***A63B 23/04*** | (2006.01) |
| ***A63B 21/062*** | (2006.01) |
| ***A63B 21/075*** | (2006.01) |
| ***A63B 21/078*** | (2006.01) |

(52) U.S. Cl.

CPC ..... *A63B 21/065* (2013.01); *A63B 21/0626* (2015.10); *A63B 21/075* (2013.01); *A63B 21/0783* (2015.10); *A63B 21/151* (2013.01); *A63B 21/4033* (2015.10); *A63B 21/4035* (2015.10); *A63B 23/0405* (2013.01); *A63B 2023/0411* (2013.01)

(58) Field of Classification Search

CPC . A63B 21/065; A63B 21/4033; A63B 21/151; A63B 23/0405; A63B 21/0626; A63B 21/4035; A63B 21/0783; A63B 2023/0411; A63B 69/0057; A63B 21/0609; A63B 23/04; A63B 21/062; A63B 21/072–075; A63B 21/0004; A63B 21/00047; A63B 21/00058; A63B 21/00061; A63B 21/00065; A63B 21/06; A63B 21/0604; A63B 21/0628; A63B 21/0632; A63B 21/4001; A63B 21/4009; A63B 21/4025; A63B 21/4029

See application file for complete search history.

(56) References Cited

U.S. PATENT DOCUMENTS 87,465 A * 3/1869 Butler ..... A63B 21/154 482/94

4,589,658 A * 5/1986 Gibson ..... A63B 21/4001 482/105

(Continued)

*Primary Examiner* — Jennifer Robertson
*Assistant Examiner* — Catrina A Letterman
(74) *Attorney, Agent, or Firm* — Nasser Ashgriz; UIPatents, Inc.

(57) ABSTRACT

The present invention is a free weight belt squat machine that allows a free, unencumbered raising and lowering of variable resistance by a user. A belt which is directly attached to the horizontal free weight bar holds standard Olympic plates and may be raised or lowered, directly in free space, by the user. Thus, the natural and optimal movement pattern of a straight line over the user's center of gravity may be fully and completely realized. This machine provides a control arm to safely and effectively engage and disengage the resistance from the machine to the user and then back to the machine. This machine further provides an adjustable stopper mechanism for the safety of the user and to limit or expand the range of the exercise to cause the desired adaptations in muscular strength and size.

13 Claims, 18 Drawing Sheets

(56) References Cited

U.S. PATENT DOCUMENTS

| | | | | |
|---|---|---|---|---|
| 5,158,520 | A * | 10/1992 | Lemke | A63B 21/06 482/103 |
| 9,931,532 | B2 * | 4/2018 | Castaneda | A63B 21/4009 |
| 2012/0220432 | A1 * | 8/2012 | Henesey | A63B 21/078 482/105 |
| 2017/0246504 | A1 * | 8/2017 | Simmons | A63B 21/00065 |
| 2018/0311522 | A1 * | 11/2018 | Schmidt | A63B 21/06 |
| 2019/0070450 | A1 * | 3/2019 | Henesey | A63B 21/4033 |
| 2020/0038704 | A1 * | 2/2020 | Adams | A63B 21/0724 |

* cited by examiner

FREE WEIGHT BELT SQUAT MACHINE

RELATED APPLICATION

This application claims priority from earlier filed US provisional patent application No. 62/736,551 filed Sep. 26, 2018.

FIELD OF THE INVENTION

The present invention relates in general to gym equipment and in particular to a belt squat machine.

BACKGROUND OF THE INVENTION

Squat exercises using weights supported by hip belts are used for strengthening the leg muscles. The current methods for performing the squat exercise with a hip belt utilize cables and pulleys and as such are also not free weight. Most existing machines do not provide free weight movement and the resistance is not controlled directly by the user. These machines do not allow the user to lift any desired amount of free weight, unless by using a lever, or cables and pulleys. As such most existing machines can only provide an unnatural, fixed and arcing movement pattern of the resistance.

Existing machines that are free weight, require an extra-large space for standard Olympic plates, which are placed horizontally, to be used as resistance, which creates a limited range of movement and necessitates an extra wide stance by the user. This does not allow the user to emphasize and exercise different parts of the legs and leg muscles for particular adaptations in muscular strength and size. In addition, these machines do not allow adequate range of movement for users of different heights, sizes and limb lengths. Further, the large space required for the Olympic plates creates a hazard for the user as he/she could miss step or slip into the space and fall, causing injury.

According to these features there is a need for a much improved equipment for performing a free weight belt squat in such a way that the user can correctly and safely lift and lower the weight in a straight line and over the user's center of gravity.

SUMMARY OF THE INVENTION

The present invention provides a free weight belt squat machine for use in squat lifts for strengthening the leg muscles. This machine comprises of an elevated rack with an elongated platform for a user to stand on. A set of steps are provided from the ground to the platform on one side of the elevated rack for the user to enter or exit the platform and a set of handrails and hand grips on the platform for the user to hold during the exercise. An adjustable chain with a length adapted to connect from one end to a belt worn by a user and from the other end to a vertical post that is affixed on a horizontal Olympic weight holder bar. The horizontal Olympic weight holder bar, with weight plates resistance loaded on either end is utilized as a variable resistance. The weight holder bar moves vertically under the platform. This machine is designed to establish a comfortable and desired range of the belt squat exercise.

The platform on which the user stands has an opening for the chain to pass through and to connect to the resistance. The opening of the platform has a dimension adapted to allow for a chain and the vertical portion of the resistance to freely pass through it. This design of a small opening provides a significant space for variable stances by the user, and different emphasis on different parts of the legs while performing the weight belt squat exercise on the platform. It can be used for various adaptations of strength and size for different muscles of the legs. It also allows for the maximal range of movement of the resistance for users of all sizes, heights and limb lengths. The prior art machines that are free weight require an extra-large space for standard Olympic plates to be used as resistance, which requires a limited range of movement and necessitates an extra wide stance by the user. This small opening in the platform further negates and removes the hazard represented by larger platform holes required by previous and existing designs as users of those machines may step into the opening with either foot and risk serious injury.

The exercise machine has a guiding system to prevent the resistance from tilting and swinging. A pair of metal plates vertically affixed to the front and back of the inside upright frames under the platform of the machine to create a tunnel under the opening to prevent the resistance from getting caught under the front or back of the platform by tilting forward or back. The smooth metal plates forcefully guide the vertical portion of the resistance and the chain connecting it to the belt to travel only straight up and down while the user is lifting and lowering the resistance. A pair of large fixed washers are provided on either side of the weight holder bars, which are larger than the vertical sides and frame of the machine within which the resistance plate holder bar moves up and down. This effectively prevents the resistance from moving side to side, under the sides of the platform.

In operation, the user loads the desired amount of resistance onto the resistance holder bar by loading equal amounts of Olympic plates on either end of the bar and then installing standard Olympic bar collars on the end of the sleeves of the bar. The user stands on the platform, directly and evenly over the opening through which the chain passes. The user stands with the center of his/her foot, from the end of the toes to the end of the heel, approximately even and aligned with the center of the hole in the platform. The user then connects the chain to an eye hook on the top portion of the vertical post of the resistance holder bar with a spring-loaded connector. One end of the belt is then connected to the other end of the chain, also with a spring-loaded connector at the desired number of chain lengths allowing for the desired range in which the user wishes to squat. The user then bends his/her knees and wraps the belt around his/her hips and connects the other end of the belt to the chain with the same, common connector, which connects the belt to the chain.

A pair of hand rails and hand grips are provided on the machine for the user to grip and stand up fully, extending knees and lifting the engaged resistance. The hand grips of the machine are variable fixed in various positions, for users of different heights, sizes and limb lengths. This allows the flexing of the hips (bending of the torso at the hips) such that the user's head and upper body can pass safely and clearly through the hand grips for correct and variable postures when squatting. Different postural positions emphasize different parts of the legs and cause specific and desired strength and size adaptations in those parts of the legs and the related leg muscles of the user. In one embodiment, the hand grips are pivotally mounted on the platform such that they can be set in or outward, depending on the arm length of the user. This provides comfort and room for the user to hold onto the grips as they squat, regardless of their arm limb length.

The exercise machine provides a resistance control arm mounted on the front side of the platform to provide a moving hand control to engage and disengage the resistance. The resistance control arm is moveable in a cavity mounted on the platform to safely engage and disengage the resistance from the machine to a user and back onto the machine. The user then pushes out the resistance control arm and proceeds to lower the resistance and complete the belt squat exercise to his/her desired depth for a desired number of repetitions. Upon completion of the exercise, the user stands up with the knees fully extended and pulls the resistance control arm inward, thus moving a metal support frame back under the resistance holder bar to then effectively and safely engage the resistance from the user back to the machine. Once the user initially extends the knees fully while wearing the belt and fully supports the resistance, the user then lowers the resistance slightly by flexing the knees such that the resistance rests once again on the belt squat machine. The user then unclips one end of the belt and removes the belt from his/her waist/hips. The user can then walk down the steps of the machine, having completed the exercise.

The present invention further provides adjustable stoppers or stopping mechanisms for the safety of the user. If the user is unable to move the weight when using heavy weights or when the user is overcome by fatigue during a set when engaging the resistance, they may simply lower or yield the resistance on the adjustable stopper. Further the stoppers are adjustable to limit or expand the range of the exercise to emphasize different muscles and allow for different range of movements by a user and cause a desired adaptation in muscular strength and size. Further, by lowering the weight purposely onto the stoppers at a particular desired position, resting it for a second and then lifting it off of the stoppers, the user is able to remove the myotatic stretch reflex from the exercise. This is a valuable and useful method and stimulus to provide a different desired physical adaptation to the leg muscles of the user.

Therefore it is an object of the present invention to provide a truly "free weight" belt squat and to allow for a free and unencumbered raising and lowering of variable resistance by a user. The resistance travels directly and freely against gravity and dynamic pattern of the movement of the resistance is controlled solely by the user.

Another object of the present invention is to provide a belt squat machine that does not use levers, cables or pulleys and thereby the user lifts the exact amount of resistance loaded onto the resistance.

It is another object of the present invention to provide a free weight movement that moves freely in space, which is directly controlled by the user.

It is another object of the present invention to provide adjustable hand grips for the users of different heights, sizes and limb lengths and allow for correct and variable postures when squatting.

It is another object of the present invention to provide a hand control mechanism to safely engage and disengage the resistance from the machine to the user and back onto the machine.

It is another object of the present invention to utilize a horizontal Olympic plate bar with plates loaded on either end, as with a typical Olympic bar. This resistance plate holding bar also weighs exactly as much as a standard Olympic bar, 45 lbs (or 20 kilograms). As such, the user has the simplicity, understanding and convenience of using standard and universally accepted Olympic plates and bar weights.

It is another object of the present invention to provide elastic band hooks for added, exponential resistance for the additional adaptations and desired specific training of the user. The addition of the band hooks allowing for 3 forms of resistance—static weight alone, bands alone, or various combinations of band resistance and free weight.

BRIEF DESCRIPTION OF THE DRAWINGS

Embodiments hereinafter will be described in conjunction with the appended drawings provided to illustrate and not to limit the scope of the claims, wherein like designations denote like elements, and in which:

DETAILED DESCRIPTION OF PREFERRED EMBODIMENTS

The invention disclosed herein, in accordance with one or more various embodiments, is described in detail with reference to the following figures. The drawings are provided for purposes of illustration only and merely depict typical or example embodiments of the disclosed technology. These drawings are provided to facilitate the reader's understanding of the disclosed technology and shall not be considered limiting of the breadth, scope, or applicability thereof. It should be noted that for clarity and ease of illustration these drawings are not necessarily made to scale.

Figure 1:
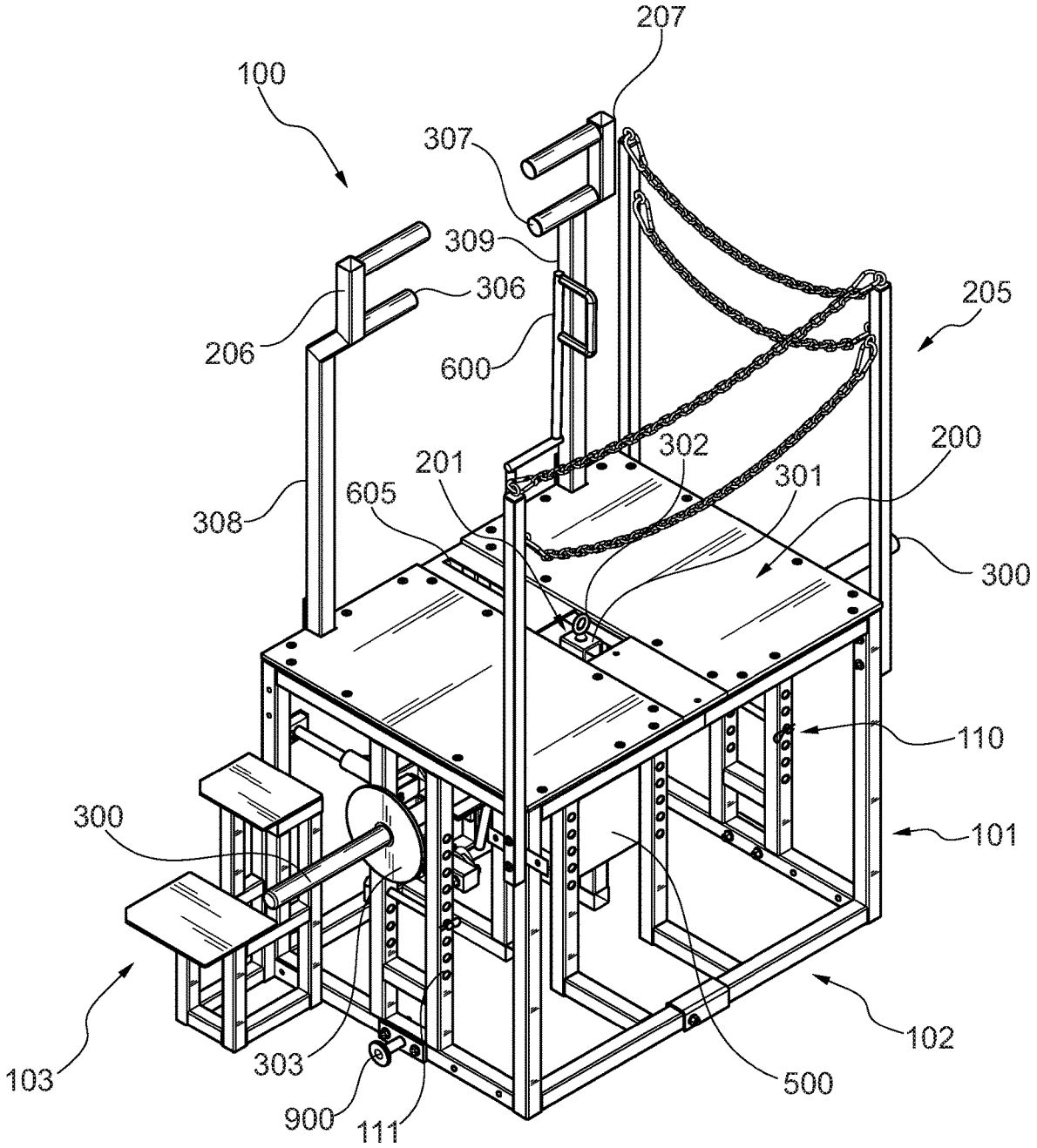
FIG. 1 is a perspective view of the free weight belt squat machine.
Figure 2:
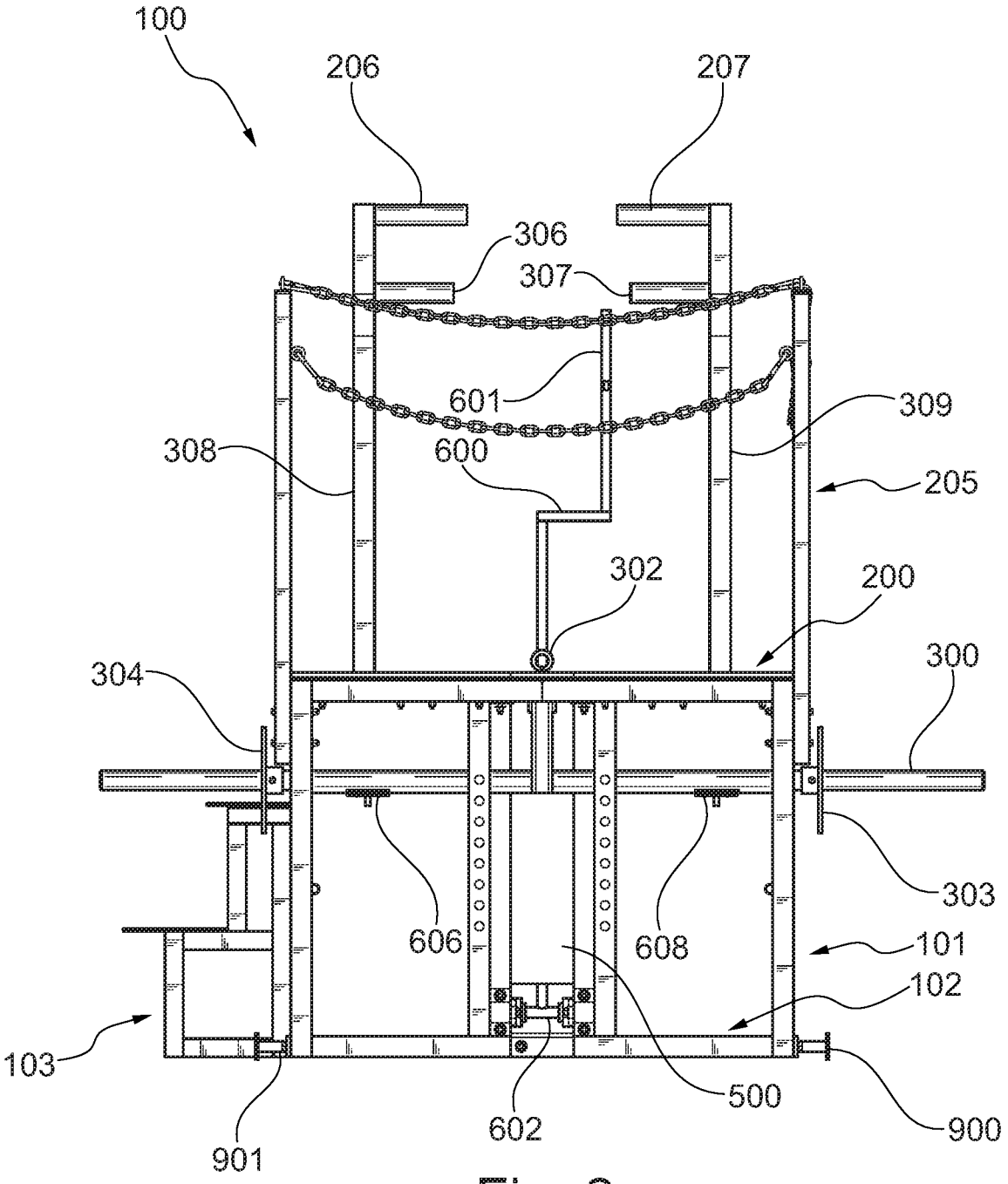
FIG. 2 is a rear view of the free weight belt squat machine of the present invention.
Figure 3:
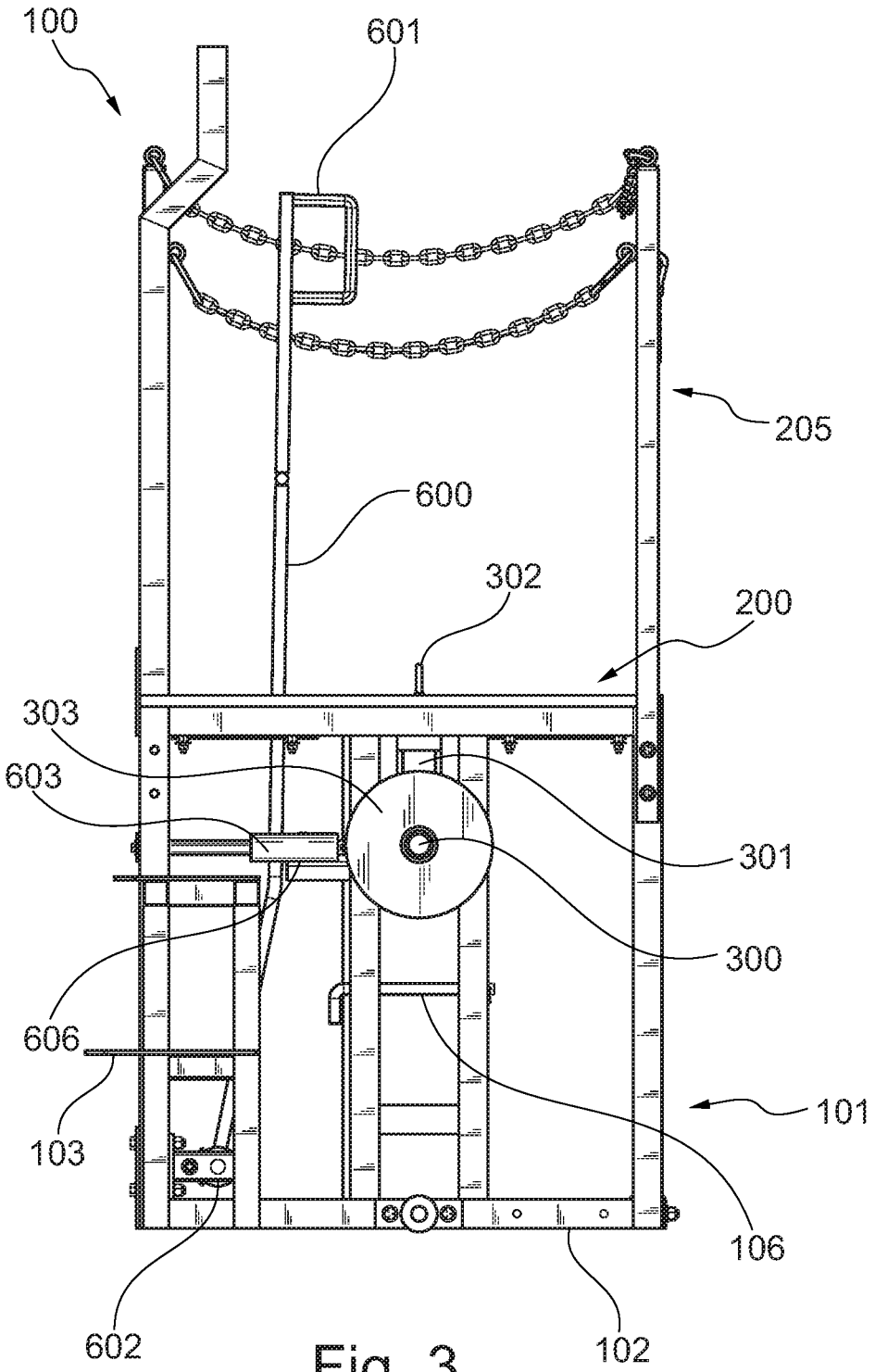
FIG. 3 is a side view of the free weight belt squat machine of the present invention.

FIG. 1 is a perspective view of the Free weight belt squat machine 100 of the present invention comprising an elevated rack 101 formed with supporting vertical beams which extend from the floor up to a platform 200 to hold and support the elevated rack 101 on the floor. The platform 200 is an area on which the user stands to perform the squat exercise. The elevated rack 101 has a base 102 for resting on the floor. The base 102 is formed by a series of elongated horizontal metal bars in combination with a series of vertical elongated metal bars to support the raised platform 200.

The elevated rack 101 and the platform 200 are preferably in a substantially rectangular shape (but can be of any other shapes) having an adequate size for a person to stand and perform the squat exercise. The elevated rack 101 comprises of a front side, a rear side, a right side and a left side. A set of steps 103 is positioned at one side of the platform 200 (left side) for the user to conveniently mount and dismount from the elevated rack 101.

Referring to FIGS. 1 to 7A a horizontal Olympic plate holder bar is provided as the resistance 300 of the machine to load with plates on either end. A vertical post 301 is connected to the center of the resistance 300. The vertical post 301 has a ring member 302 fastened on the top end thereof to connect to the belt used by the user of the machine 100. Resistance 300 moves vertically under the platform 200 of the elevated rack 101 and remains below the platform 200.

Figure 4:
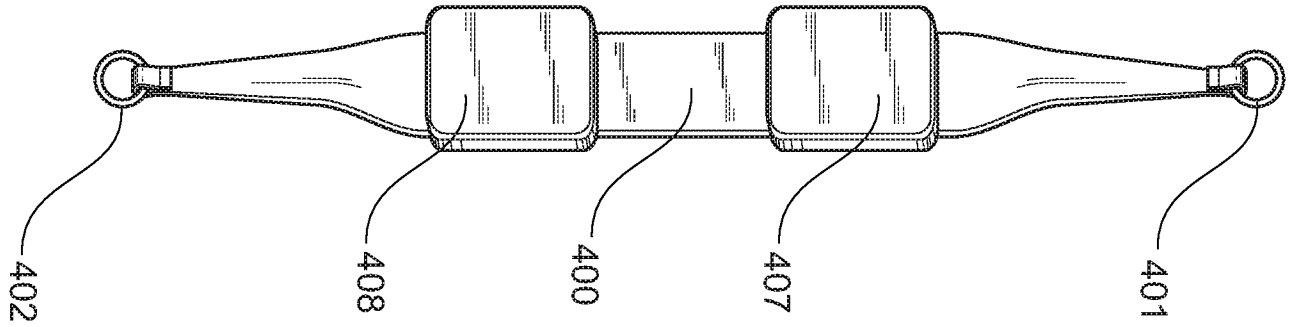
FIG. 4 is a perspective view of the belt of the present invention.

According to FIG. 4 the belt 400 used in accordance with the present machine 100 is widely used by the body builders and is readily available in most gyms. The belt 400 includes heavy metal buckles 401 and 402 on each end of the belt 400. Because of the heavy loads carried by this belt 400, it has been found beneficial to add cushioning means or padding or thick foams 406 407 and 408 on the sides of the belt 400 so as to prevent cuts and tight compression against the skin of the user as the weights are being raised and lowered during the power squat lifts.

Figure 5:
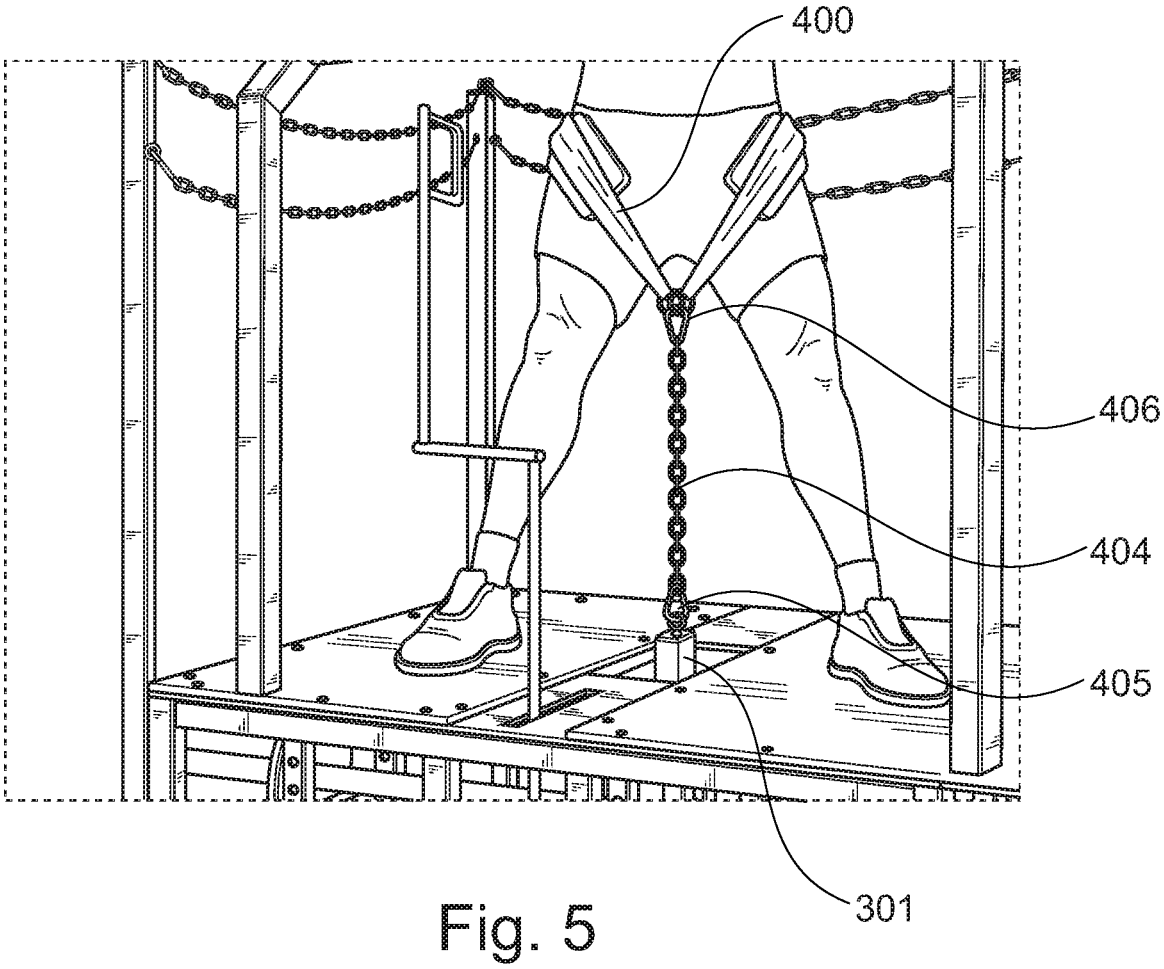
FIG. 5 is a front view of the present invention showing the connection of the belt and the chain in combination with the vertical post of the resistance.
Figure 6:
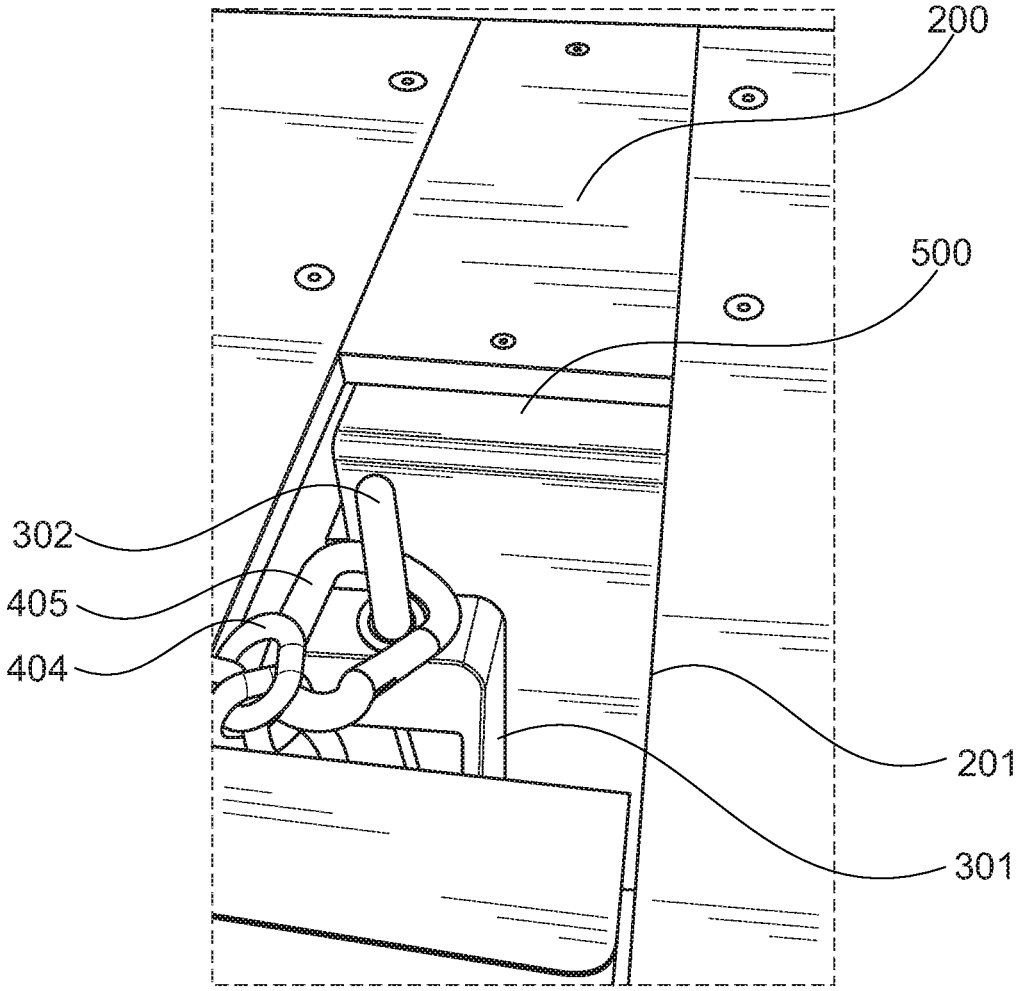
FIG. 6 is a perspective view of the platform opening showing the vertical post of the resistance and the connection of the chain.

As shown in FIGS. 5 and 6 an adjustable chain 404 connects the vertical post 301 to the belt 400. The chain 404 has a length adapted to be connected to the belt 400 from its distal end and to the vertical post 301 from its proximal end. A set of releasable connectors 405 and 406 are provided on the distal end and proximal end of the chain 404. The chain is connected to the ring member 302 of the vertical post 301 from its proximal end. The buckles of the belt 401 and 402 are releasably connected to the distal end of the chain 404. The chain 404 extends from the belt 400 and connects to the ring member 302 at the upper end of the vertical post 301. The releasable connectors of the chain 405 and 406 may engage any one of the links of the chain 404 in order to adjust the length of the chain, depending upon the height of the user and for the desired range the user wishes to lower and lift the resistance.

Referring to FIGS. 1,5 and 6 the platform 200 has an opening 201 constructed on the center of the platform 200 for the chain 404 to pass through and perform a connection of the chain 404 from the user's belt 400 to the resistance (holder bar) 300. The Olympic plates, which represent the variable resistance 300, are loaded on either end of the Olympic plate holder bar. The user loads the desired amount of weight plates onto the plate holder bar by loading equal amounts of Olympic plates on either end of the bar. Two large washers 303 and 304 are provided on either end of the holder bar of the resistance 300, allowing the resistance 300 to only move in a limited range of distance and prevent the centered, vertical post 301 from moving laterally—from side to side—and getting caught under the sides of the platform 200.

Figure 7A:
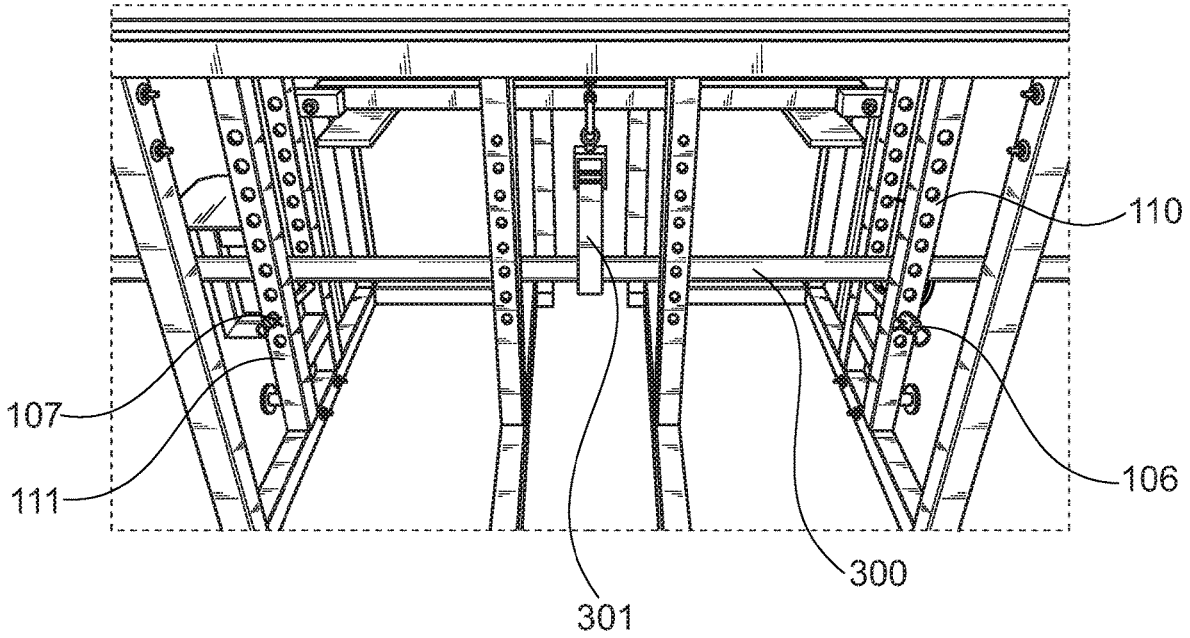
FIG. 7A is a perspective view of the elevated rack showing the vertical post and the adjustable stoppers of the present invention.
Figure 7B:
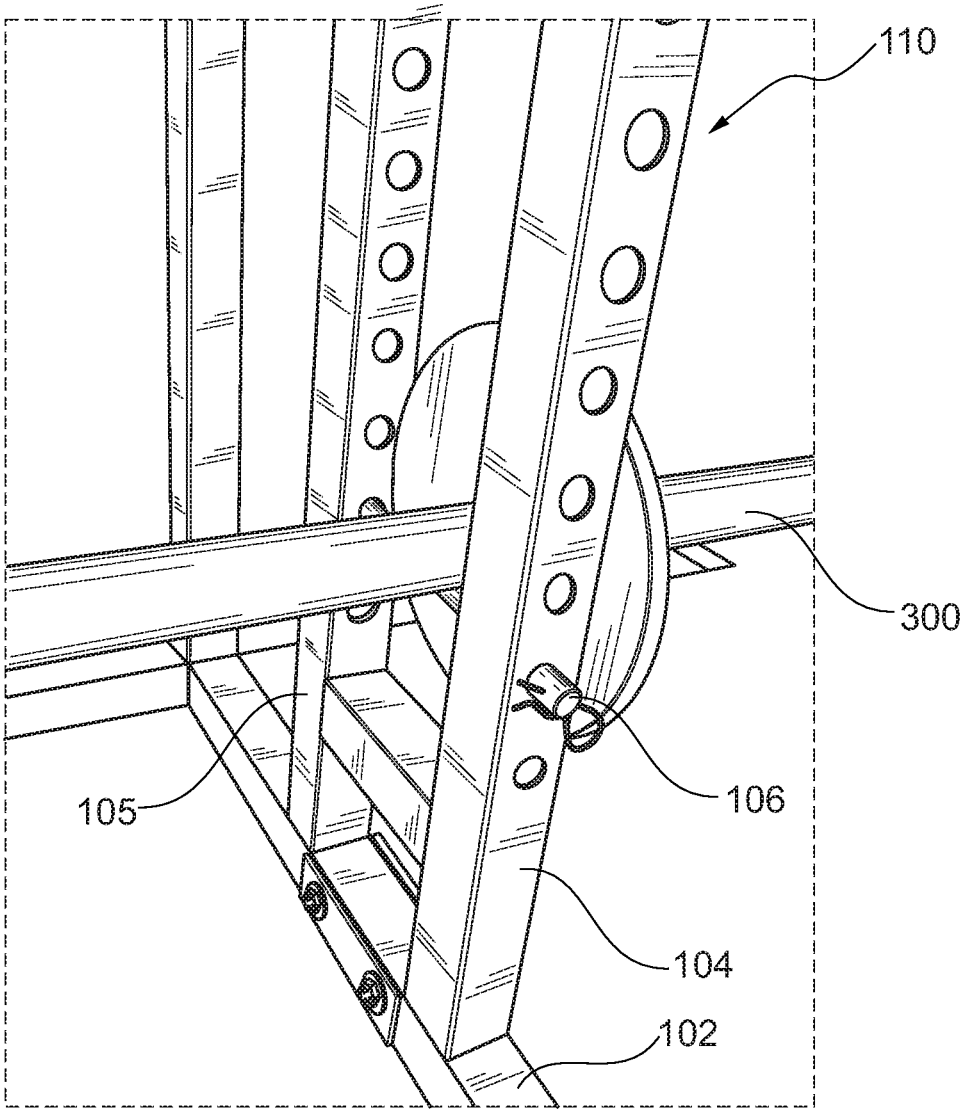
FIG. 7B is a perspective view of one side of the elevated rack showing the mechanism of the adjustable stoppers.
Figure 8A:
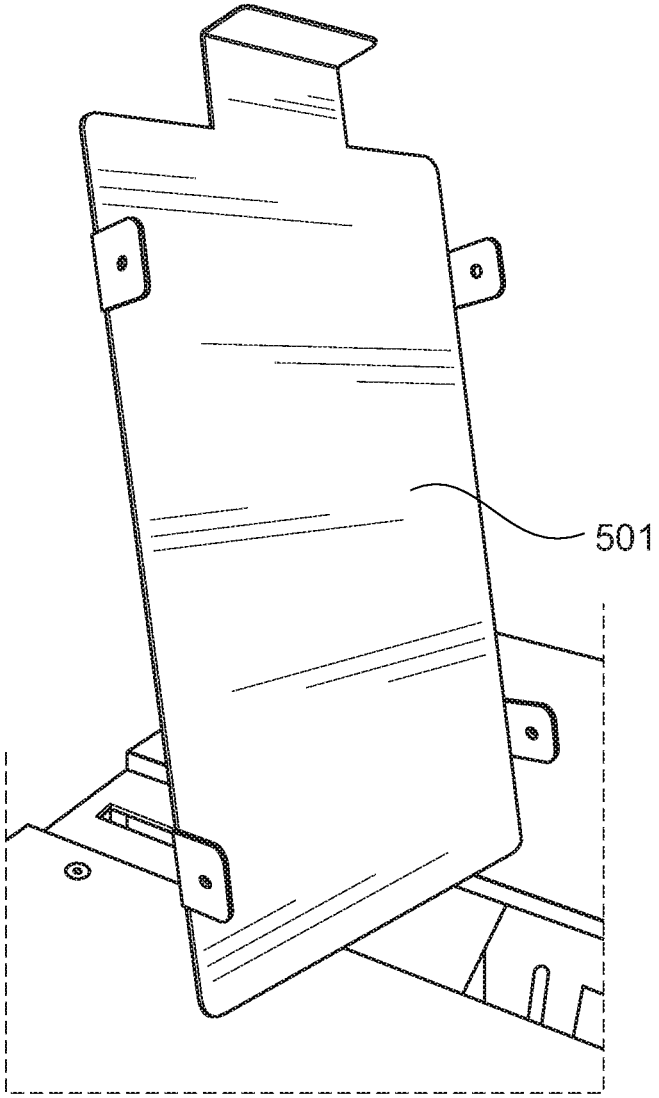
FIG. 8A is a perspective view of the metal plates of the guiding system provided in the machine.
Figure 8B:
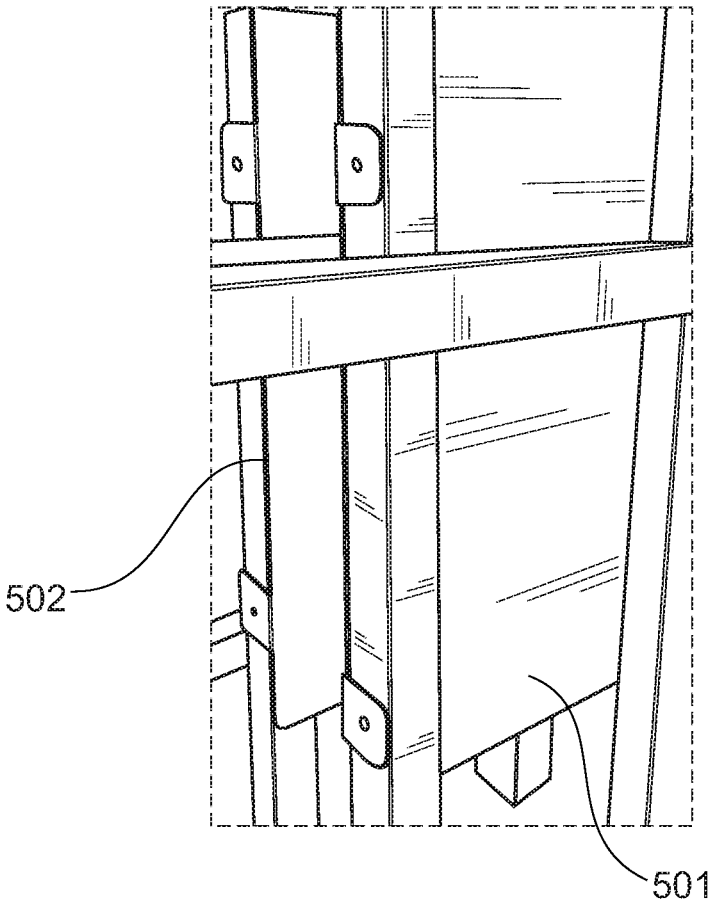
FIG. 8B is a perspective view of the metal plates of the guiding system installed on the upright frames of the elevated rack.
Figure 9:
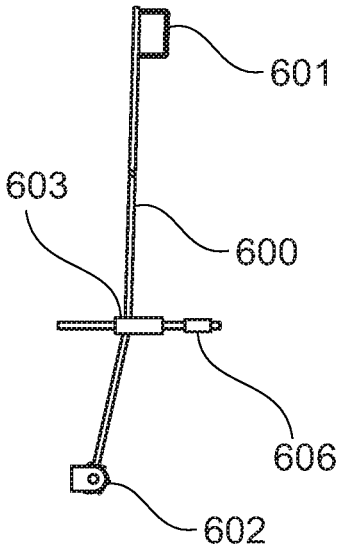
FIG. 9 is a perspective side view of the resistance control arm of the present invention.
Figure 10:
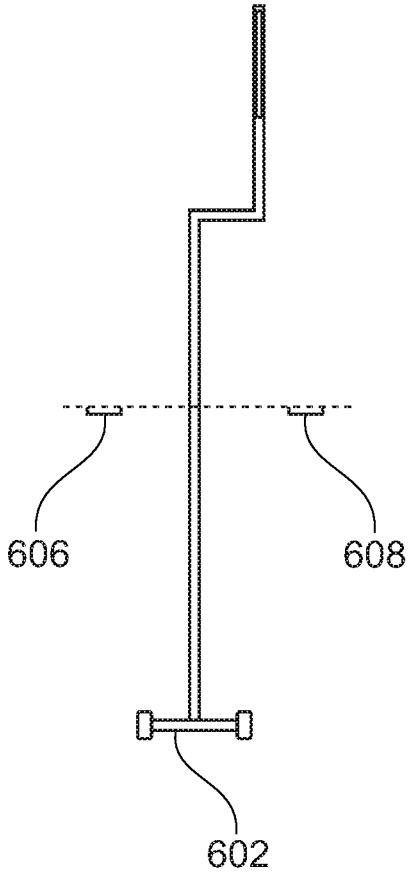
FIG. 10 is a perspective view of the resistance control arm of the present invention.

According to FIGS. 7A and 7B a set of adjustable stoppers 110 and 111 as a stopping mechanism of the exercise machine are provided on both sides of the elevated rack 101 and provide the desired adaptations in muscular strength and size. The adjustable stoppers comprise of a pair of vertical metal bars each having a set of apertures thereon with predefined distances and a pin to be inserted in the set of apertures to adjust the length for the range of the belt squat exercise. FIG. 7B shows the stopper 110 which comprises a set of vertical bars 104 and 105 with apertures provided thereon in a predefined distance. A set of pins 106 and 107 in communication with the apertures are provided to expand or limit the ranges of the exercise. More importantly, these adjustable stoppers 110 and 111 allow for the safe use of this machine as the user can adjust the stoppers just below the desired range in which they will squat, such that if they cannot complete the squatting exercise because they have used too much resistance weight or because they are fatigued, they can yield the bar holder 300 onto the stopper pins 106 and 107 and safely remove the belt 400 from their waist, thus avoiding being pulled down and otherwise trapped or injured by the heavy resistance.

According to FIGS. 1,2,6, 8A and 8B the present invention further comprises of a guiding system 500 for preventing the resistance from tilting and swinging while moving vertically under the platform, so that the weights cannot swing sidewise. As shown clearly in FIGS. 8A and 8B a pair of rectangular metal plates 501 and 502 are sized to be installed apart from each other under the upright frames of the platform 200. The metal plates 501 and 502 are installed vertically and parallel to each other and perpendicular to the opening 201 of the platform 200 on either side of the opening 201. These plates 501 and 502 create a tunnel in which the resistance 300 can move upward and downwards without tilting. This prevents the vertical post 301, from getting caught under parts of the platform 200 to the front and back of the opening 201 through which the chain 404 connects the resistance 300 to the belt 400. This guiding system in combination with the washers 303 and 304 provided on either end of the resistance 300, allows the bar to only move in a limited range of distance and prevent the centered, vertical post 301 of the resistance 300 from moving laterally—from side to side—and getting caught under the sides of the platform 200.

Referring to FIGS. 1, 2 and 3 again a safety railing 205 is fixed on the platform 200 for the safe entry, exit and use of the machine by the user. The safety railing 205 is formed around the edges of the platform 200 to support the user from back and sides. Corner posts in combination with chains or bands are used as the support means of the safety railing 205. The rear portion of the safety railing comprises of a removable or expandable chain to allow larger users to extend their hips backward when squatting.

A pair of variable hand grips 206 and 207 are provided on the front side of the platform 200 for users of different heights, sizes and limb lengths. The hand grips 206 and 207 allow the flexing of the hips (bending of the torso at the hips) such that the user's head and upper body can pass safely and clearly through the hand grips 206 and 207 for correct and variable postures when squatting. Additional hand grips 306 and 307 may be provided on the vertical frames 308 and 309 e.g. approximately the halfway point on the vertical frames 308 and 309. This will provide additional variability for users of different arm lengths and preferences. Different postural positions emphasize different parts of the legs and cause specific and desired strength and size adaptations in those parts of the legs and the related leg muscles of the user.

In another embodiment, the variable hand grips 206 and 207 provide pivot connectors (not shown) to pivot or swivel forward and backward slightly to different adjustable positions where they may be fixed. This provides for the comfort of the user and for users of different arm lengths, such that they have adequate space to hold onto the hand grips 206 and 207 and squat effectively.

With machines such as this which are typically loaded with heavy weights, the safety of the user is of the upmost importance. The major problem with many of these existing machines is that the user may be injured, if the user can not complete a repetition. It is important to provide a system to safely stop the machine. According to FIGS. 1, 2, 3, 9 and 10 the machine is equipped with a mechanism to control the movement of the resistance 300 by the user. A resistance control arm 600 is mounted on the front right side of the platform 200 and moves forward and backwards in a cavity 605 constructed on the platform 200.

The user can control the movement of the resistance 300 to safely engage and disengage the resistance from the machine to the user and back onto the machine 100. The control arm 600 is an elongated "L" shaped bar 600, which has a handle on its distal end 601 for the user to grip the control arm 600 and engage or disengage the machine. The control arm 600 is connected pivotally to a bearing 602 from its proximal end to enable the control arm 600 to move forward and backwards in respect to the cavity 605. The control arm 600 moves a set of catches 606 and 608 to hold the resistance 300. The movement of the control arm 600 is achieved by a piston 603 which directs the catches 606 and 608 to hold the resistance on both sides. The user can stop the exercise with the control arm 600 in any time.

Figure 11:
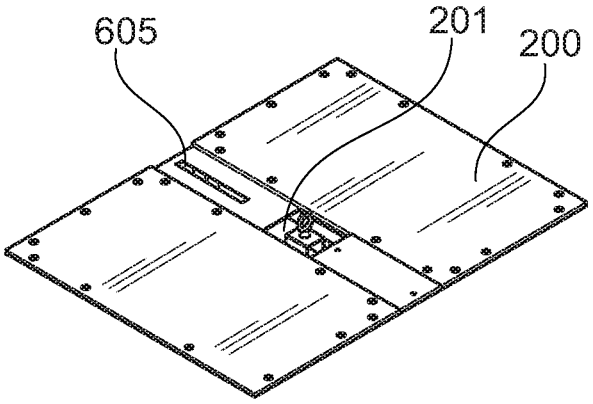
FIG. 11 is a top view showing the platform of the present invention and the position of the openings thereon.
Figure 12A:
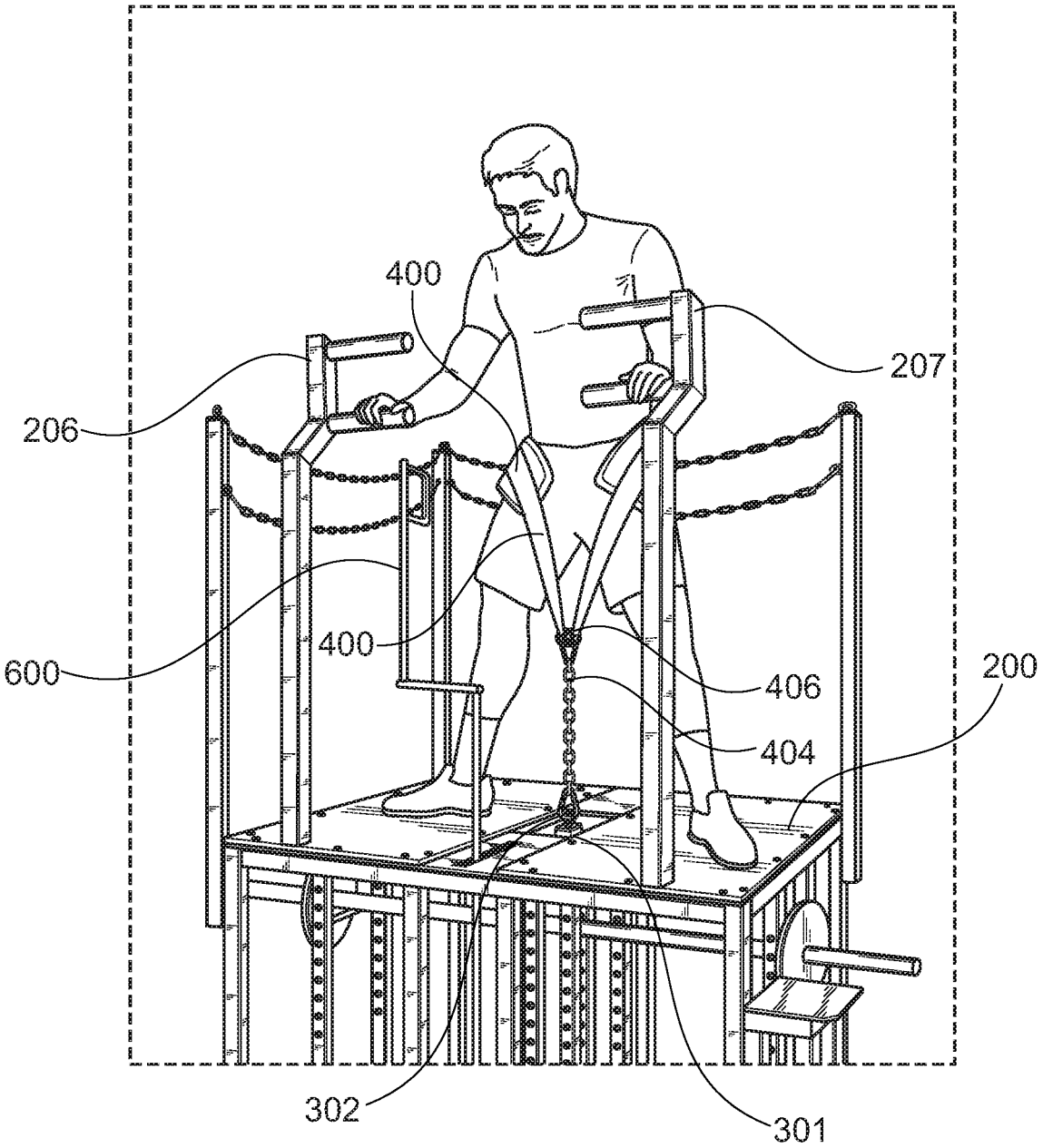
FIG. 12A is a perspective view showing a user performing free weight belt exercise.
Figure 12B:
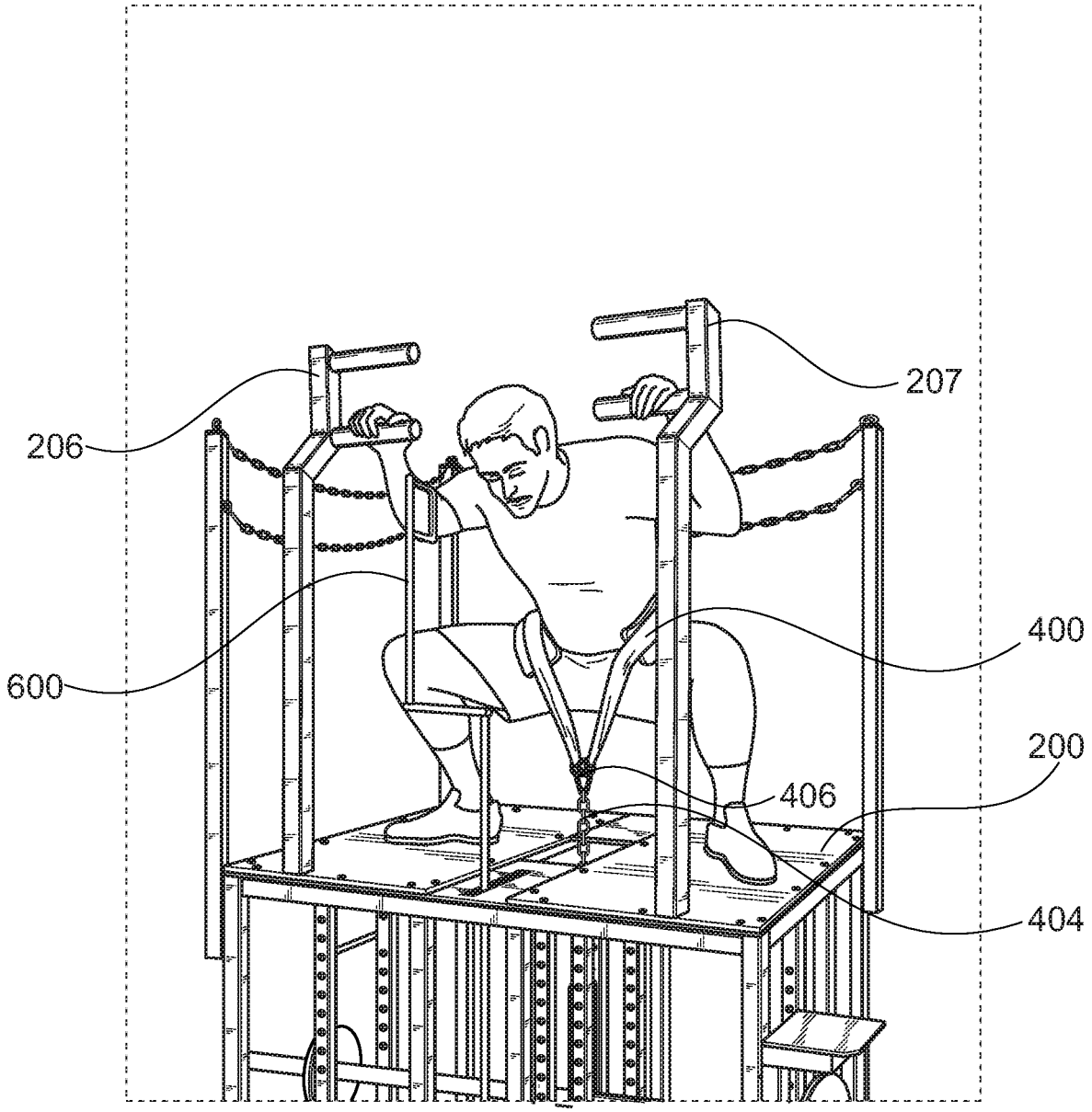
FIG. 12B is a perspective view showing a user performing free weight belt exercise.
Figure 12C:
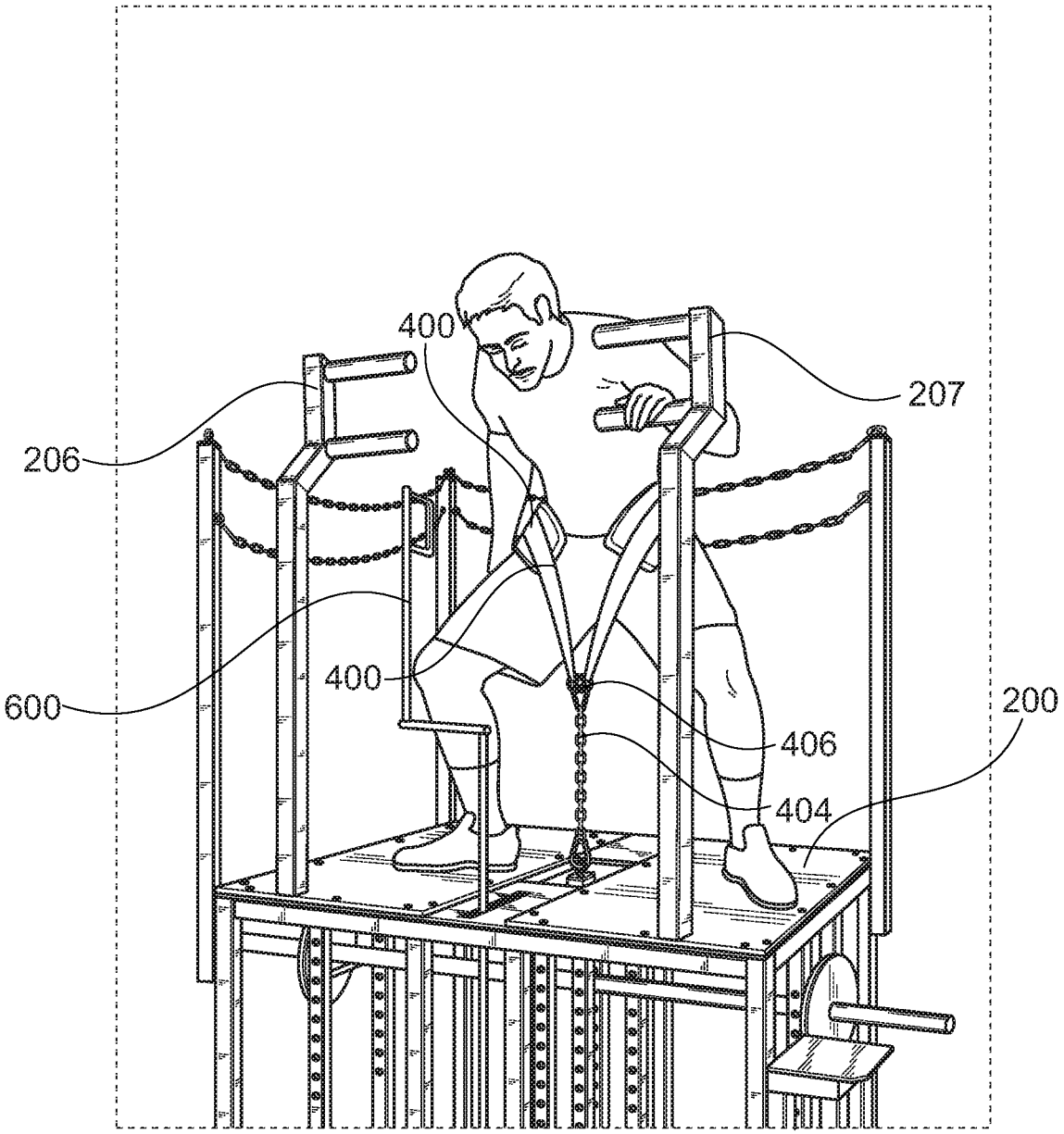
FIG. 12C is a perspective view showing a user performing free weight belt exercise.
Figure 12D:
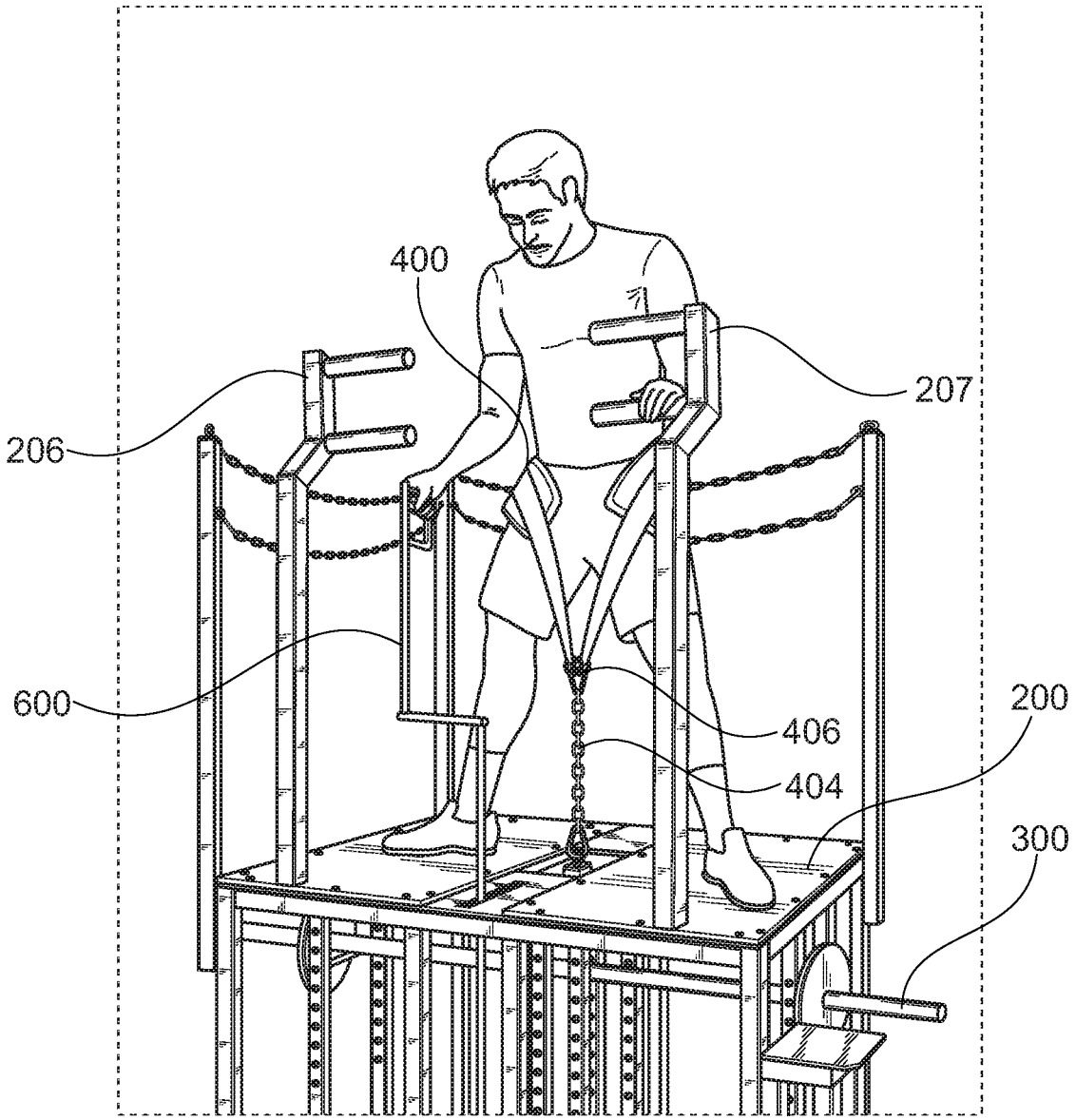
FIG. 12D is a perspective view showing a user performing free weight belt exercise.

FIG. 11 shows the position of the cavity 605 on the platform 200 in which the control arm 600 moves and the position of the opening 201 from which the belt 400 connects to the resistance 300 and moves upwardly and downwardly to perform the squat exercise. The opening 201 that is constructed in the center of the platform for the chain 400, allows for variable stances by the user and emphasis of different parts of the legs and thus various adaptations of strength and size for different muscles of the legs. This also allows for the maximal range of the movement of the resistance. This range will accommodate users of all sizes, heights and limb lengths.

As shown in FIGS. 12A to 12D in operation the user loads the desired amount of weight onto the symmetrical Olympic plate holder bar as the resistance 300 by loading equal amounts of weight plates on either end of the bar. The user stands on the platform 200 directly and evenly over the space in which the chain 404 passes the platform opening 201 and connects the buckle on one end of the belt 400 to the connector 406 of the chain 404. The user then wraps the belt 400 around his/her hips, bends the knees slightly and connects the other end of the belt 400 to the chain 404 at the desired length of the chain to establish a comfortable and desired range of the belt squat exercise. The user then grips the handles 206 and 207 and stands up fully, extending knees completely and thereby lifts and engages the resistance 300. Since this machine 100 allows for a completely free weight belt squat exercise, the user may wish to not use the handles 206 and 207 and simply hold his/her hands to the sides or in front in space while balancing the weight over the user's center of gravity during squatting.

By pushing out the resistance control arm 600 the resistance 300 will be released, and the user can complete the belt squat exercise to his/her desired depth for the number of repetitions desired. Upon completion of the exercise, the user stands up with the knees fully extended and pulls the resistance control arm 600 fully inward, thus engaging the resistance from the user back on to the machine 100. The user then lowers the weight slightly by flexing the knees such that the resistance rests once again on the catches 606 and 608 of the machine 100. The user then unclips one end of the belt 400 and removes the belt from his/her waist/hips. The user then walks down the steps 103 of the machine, having completed the exercise.

Figure 13:
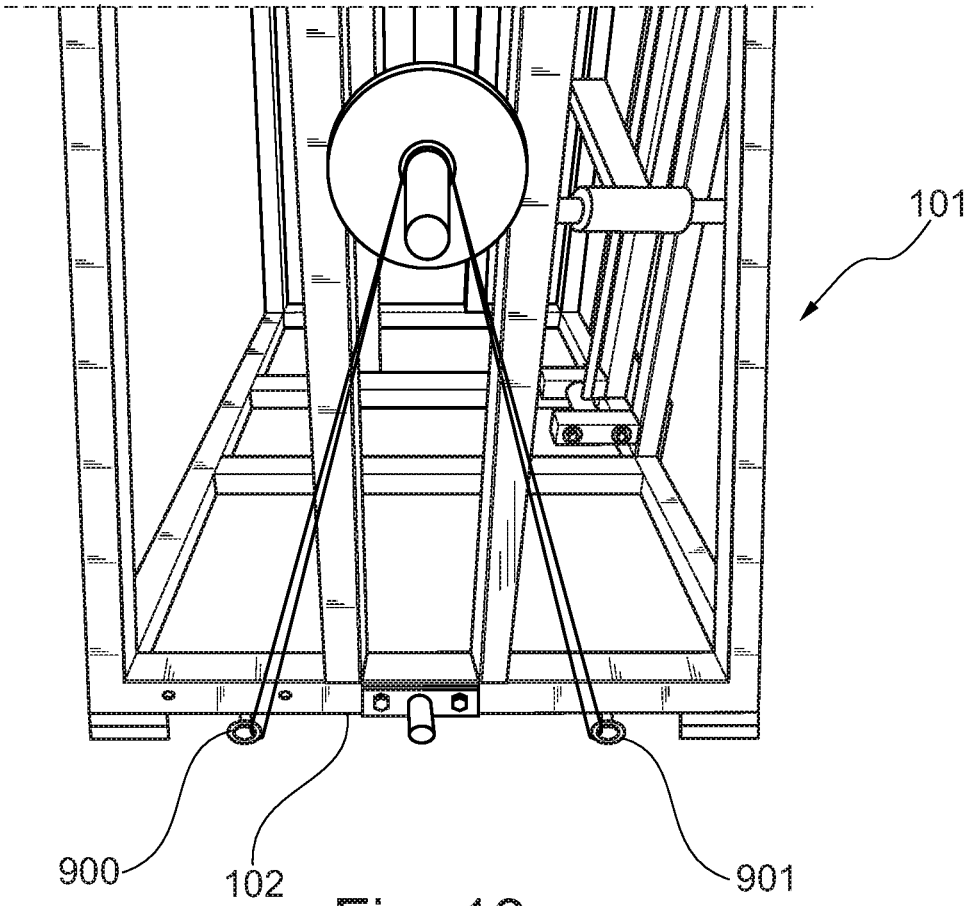
FIG. 13 is a perspective side view of the present invention showing the band hooks.

As shown in FIG. 13 this machine further includes elastic band hooks 900 and 901 for added, exponential resistance for the additional adaptations and desired specific training of the user. The addition of the band hooks 900 and 901 allows for three forms of resistance: static weight alone, bands alone, or various combinations of band resistance and free weight. The band hooks 900 and 901 are located on the elongated horizontal side bars of the base of elevated rack 102 and each one is centered directly between the two front and rear horizontal posts on each side of the machine. In this way, the band hooks will be out of the way of plates loaded onto the resistance 300 and this will increase the possible range of the machine 100, as the plates will not come into contact with the band hooks when lowered close to the floor. Thus, a total of two band hooks 900 and 901 on each side of the elevated rack 101 are located on the bottom frame 102 of the machine.

Further, in this embodiment, the bands will be looped around one band hook 900 and over one end of the weight holder bar of the resistance 300 and then finally looped to the second band hook 901 in a triangle shape. This creates band tension at the bottom of the squat movement when the weight holder bar of the resistance 300 is closest to the floor and will therefore help to keep the bands in place.

Figure 14:
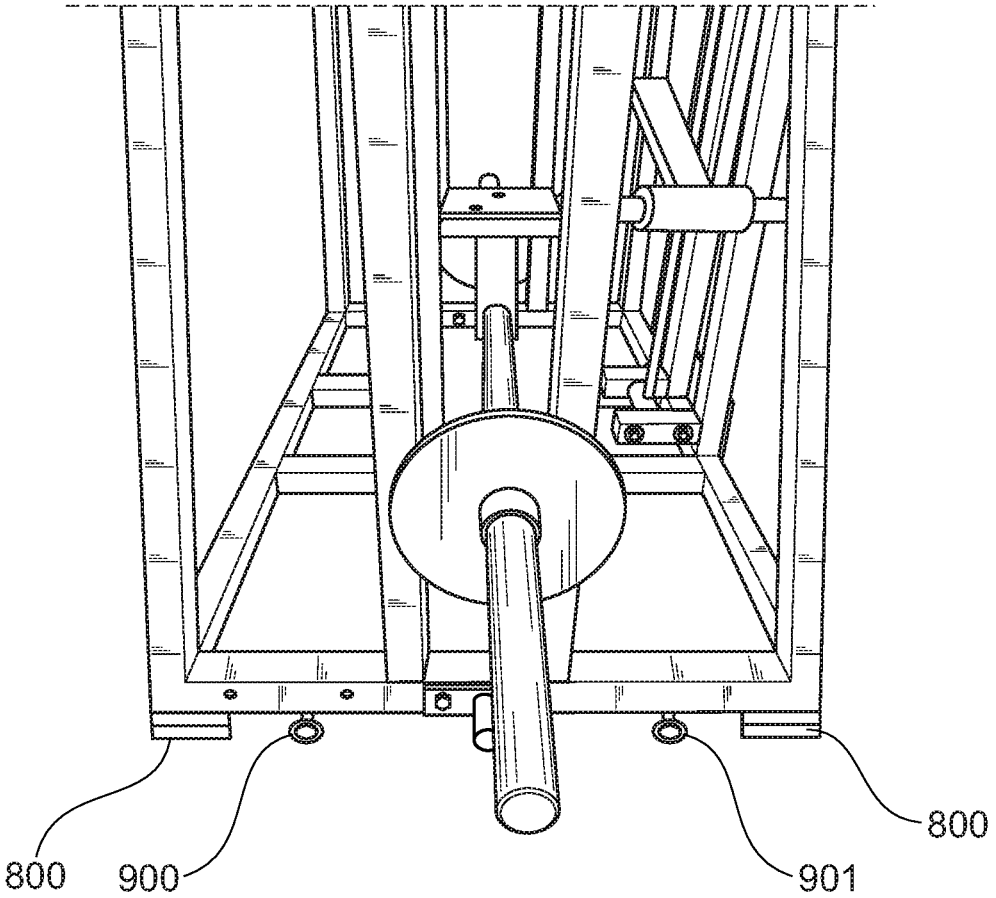
FIG. 14 is a perspective side view of another embodiment of the present invention showing a series of rubber and metal bases on the bottom of the base frame.

According to FIG. 14 in another embodiment of the present invention, a series of adjustable rubber and metal bases or risers 800 are provided on the bottom of the base frame 102 for connecting the base far of the machine to the floor, utilized to raise the height of the machine 100. This will allow for the increase in the range in which the resistance and plates may travel and thus allow extra tall users with long legs to successfully and effectively use this machine.

Figure 15:
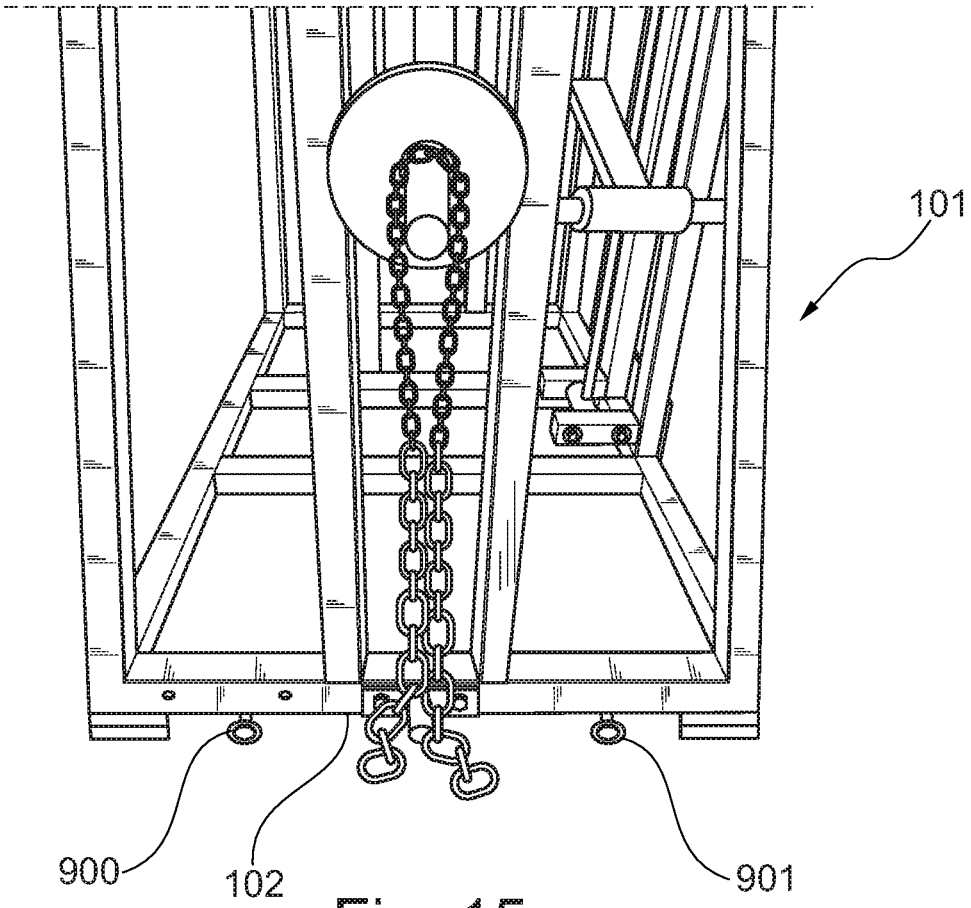
FIG. 15 is a perspective view showing another operation of the exercise machine.

As shown in FIG. 15 the current design of the machine by using a horizontal, Olympic plate holder bar as a resistance 300 in weight belt squat exercise, will also easily allow for the use of chains to accommodate resistance, by draping the chains over the ends of the weight holder bar which, when the bar is lowered, will lower onto the floor and thus remove the weight of the chains. When the bar is lifted, the weight of the chains is then gradually added back as they are lifted off the floor. This design elegantly allows this common use of chains with a typical weight holder bar whereas other existing and previous designs do not.

In another operation of the present invention, two chains 404 may be utilized instead of one chain 404, each connected to one common spring-loaded connector which is attached to the ring member 302 on the top portion of the vertical post 301 and with each other end of the chains attaching separately to each buckle of the belt 401 and 402. This may be a more comfortable option for some users as this will allow for a less tight belt around the user's hips while still allowing the exercise to be performed safely and effectively.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

What is claimed is:

1. A free weight belt squat exercise machine to perform a belt squat exercise comprising:

a) an elevated rack having a set of elongated horizontal metal bars building a base frame in combination with a set of vertical elongated metal bars, said elevated rack having a front side, a rear side, a right side and a left side;

b) an elongated platform sized for a person to stand and perform a squat exercise, said elongated platform comprising: a front side, a rear side, a right side, a left side;

c) a resistance comprising a weight holder bar with weight plates loaded on either end and a vertical post attached to a center of the weight holder bar;

d) a belt being worn by a user and connected to the resistance via a chain;

said belt and the resistance are connected through an opening constructed on the elongated platform;

e) a resistance control arm mounted on the front side of the elongated platform to provide a hand control, said resistance control arm is moveable in a cavity on the elongated platform to safely engage and disengage the resistance;

f) a guiding system for preventing the resistance from tilting and swinging while moving vertically under the elongated platform;

g) a stopping mechanism comprising a set of adjustable stoppers on the right side and the left side of the elevated rack to limit or expand a range of the belt squat exercise, whereby the resistance is vertically moveable under the elongated platform during the squat exercise performed by the user while the user moves between a full standing position and a full squatting position with maximal range of the movement of the resistance.

2. The free weight belt squat exercise machine of claim 1, wherein the guiding system comprises:

a) a pair of rectangular upright metal plates installed parallel to each other under the opening of the elongated platform to build a tunnel and to guide said vertical post;

b) a set of large washers provided on either side of the weight holder bar to control the lateral or side to side movement of the vertical post and the weight holder bar and limit the range of distance they can travel, whereby the resistance moves straight up and down without moving laterally and tilting and swinging.

3. The free weight belt squat exercise machine of claim 1, wherein each set of adjustable stoppers comprises: a pair of vertical metal bars each having a set of apertures thereon with predefined distances, a set of stopper pins to be inserted in the set of apertures to adjust a length for the range of the belt squat exercise, whereby the user can yield the resistance onto the set of stopper pins.

4. The free weight belt squat exercise machine of claim 1, wherein said resistance control arm comprises:

a) a "L" shaped bar having a handle on its distal end and extending through the cavity on the elongated platform and pivotally connected to a bearing that is fixed on the base frame from its proximal end;

b) a set of catches positioned on either sides of a horizontal bar that is attached to the resistance control arm at a predefined height;

whereby the resistance control arm moves forward and backwards in the cavity directing the set of catches to engage and disengage the resistance from the machine.

5. The free weight belt squat exercise machine of claim 1, wherein the chain has a set of releasable connectors on its distal end and proximal end to adjustably connect to the belt from its distal end, and to the vertical post from its proximal end, whereby a length of the chain is adjusted depending on the height of the user to establish a comfortable and desired range of the belt squat exercise.

6. The free weight belt squat exercise machine of claim 5, wherein the belt comprises a set of buckles provided on each end of the belt to engage to the set of releasable connectors of the chain.

7. The free weight belt squat exercise machine of claim 1, further has a set of variable hand grips on the front side of the elongated platform for users of different heights, sizes and limb lengths, wherein said set of hand grips allow the flexing of the hips such that the user's head and upper body can pass safely and clearly through the hand grips for correct and variable postures when squatting.

8. The free weight belt squat exercise machine of claim 1, further provide a set of safety railings on the rear side and right side of the elongated platform comprising of removable and expandable chains installed on a set of corner posts to allow larger users to extend their hips backwards when squatting.

9. The free weight belt squat exercise machine of claim 1, wherein said opening is provided on a center of the elongated platform and sized to allow for only the chain and the vertical post to freely pass there through and perform a connection of the chain from the belt to the resistance while providing a wide space for maximal range of movement for a user of all sizes, heights and limb lengths.

10. The free weight belt squat exercise machine of claim 1, wherein said belt provides an interior padding for supporting the weights during the power squats performed by the user.

11. The free weight belt squat exercise machine of claim 1, wherein said machine provides band hooks installed on the base frame for added, exponential resistance for the additional adaptations and desired specific training of the user and allowing for three forms of resistance comprising: static weight alone, bands alone or various combinations of band resistance and free weight.

12. The free weight belt squat exercise machine of claim 1, wherein said machine provides a series of risers installed on the bottom of the base frame for connecting the base frame to the floor, thereby to raise the height of the machine and allow extra tall users with long legs to successfully and effectively use the machine.

13. The free weight belt squat exercise machine of claim 12, wherein the series of risers are selected from rigid rubber or metal material.

* * * * *